US005127313A

United States Patent [19]

Yonezawa

[11] Patent Number: 5,127,313

[45] Date of Patent: * Jul. 7, 1992

[54] PRESSURIZED OIL SUPPLY/DISCHARGE CIRCUIT AND VALVE DEVICE FOR USE IN SAID CIRCUIT

[75] Inventor: Keitaro Yonezawa, Kobe, Japan

[73] Assignee: Kabushiki Kaisha Kosmek, Hyogo, Japan

[ * ] Notice: The portion of the term of this patent subsequent to Jun. 30, 2009 has been disclaimed.

[21] Appl. No.: 714,013

[22] Filed: Jun. 12, 1991

[30] Foreign Application Priority Data

Jun. 22, 1990 [JP] Japan ..... 2-164977

[51] Int. Cl.[5] ..... F15B 13/02

[52] U.S. Cl. ..... 91/447; 91/451; 137/493.3; 137/493.6; 137/493.9; 137/599; 137/599.2

[58] Field of Search ..... 91/445, 447, 451; 137/493.3, 493.6, 493.9, 599, 599.2

[56] References Cited

FOREIGN PATENT DOCUMENTS 54-108156 8/1979 Japan .
1-240242 9/1989 Japan .

*Primary Examiner*—Gerald A. Michalsky
*Attorney, Agent, or Firm*—Bacon & Thomas

[57] ABSTRACT

A check valve (14) with a valve opening actuator function and a bypass opening/closing valve (17) are disposed in parallel in a pressure oil supply/discharge passage (3) connected in communication with a hydraulic actuation chamber (2). The opening/closing valve (17) is adapted to be held at a valve opened position (Y) against a residual pressure holding spring (19) when the pressure on the check valve inlet (14*a*) side is normal and to be changed over to a valve closed condition (X) by means of the spring (19) when the pressure has lowered to a predetermined value. The pressure oil supply/discharge passage (3) and a pressure discharge passage (7) are connected in communication with each other through a pressure compensation valve (12). The opening/closing valve (17) is composed of a piston valve member (38) resiliently biased against a bypass valve seat (40) by means of the spring (19).

11 Claims, 10 Drawing Sheets

F
P
A
2
11
15
17
17a
19
21
27
28
29
30
30a
31
33
33a
33b
34
35
38
39
39a
40
41
44
14
14a
14b
16

PRESSURIZED OIL SUPPLY/DISCHARGE CIRCUIT AND VALVE DEVICE FOR USE IN SAID CIRCUIT

BACKGROUND OF THE INVENTION

1. Field of the Invention

The present invention relates to a pressurized oil supply/discharge circuit with a residual pressure holding function and a residual pressure holding valve device for use in the pressurized oil supply/discharge circuit, all of which are adapted to leave a predetermined pressure remaining within a hydraulic actuation chamber even in the event that a breakage of a hydrualic hose and the like causes an oil leak in a pressurized oil supply/discharge passage connected to the hydraulic actuation chamber of a hydraulic cylinder.

2. Description of the Prior Art

A known pressurized oil supply/discharge circuit with a residual pressure holding function has been disclosed in Japanese Patent Laid Open Publication No. 1979-108156.

As shown in a circuit diagram of FIG. 17, this publication discloses a hydraulic cylinder applied to a clamping device.

That is, a clamping hydraulic actuation chamber 203 is formed in the one side of a piston 202 of a double-acting type hydraulic cylinder 201, a check valve 205 with a forcibly valve-opening (valve actuating) function is disposed in a clamping pressure oil supply/discharge passage 204 connected to the hydraulic actuation chamber 203, and an unclamping pressure oil supply/discharge passage 207 is connected to an unclamping actuation chamber 206 formed in the other side of the piston 202.

At the time of clamping, actuating oil is discharged from the unclamping hydraulic actuation chamber 206 and the pressurized oil is supplied to the clamping hydraulic actuation chamber 203, so that the hydraulic cylinder 201 is operatively contracted to press and fix a fixed or clamped object 210 by means of a clamping member 209. Under this clamped condition, when a pressure on the inlet side of the check valve 205 abnormally drops due to a breakage of a hydraulic hose and the like, the check valve 205 serves to prevent a counter flow so as to leave or maintain a pressure within the clamping hydraulic actuation chamber 203 and thus to prevent a shift and/or a fall of the fixed object 210. Incidentally, slight leakage of pressure from the check valve 205 is supplemented by means of an accumulator 211.

On one hand, at the time of unclamping, when the pressurized oil is supplied from the unclamping oil supply/discharge passage 207 to the unclamping hydraulic actuation chamber 206, the check valve 205 is opened by means of hydraulic pressure via a pilot oil passage 213, so that a discharge of oil from the clamping hydraulic actuation chamber 203 is allowed and the hydraulic cylinder 201 is operatively extended.

The above-mentioned prior art has the advantage that the clamping condition can be held by means of a one-way checking function of the check valve 205 even though a leakage of pressurized oil is caused on the inlet side of the check valve 205, but there is the following problem associated therewith.

For example, like in a hydraulic clamping device for a metal mould of an injection moulding machine, when the hydraulic cylinder is subjected to a raised temperature under the clamping condition, pressure within the clamping hydraulic actuation chamber 203 can gradually increase or build up due to volumetric expansion of the trapped pressure oil. Accordingly, the clamping force of the hydraulic cylinder 201 increases sufficiently great so as to cause concern over damage of a clamped or fixed object 210.

SUMMARY OF THE INVENTION

It is an object of the present invention to make trapping a pressure within a hydraulic actuation chamber by means of a check valve compatible with preventing an excessive pressure increase within the hydraulic actuation chamber.

For accomplishing the above-mentioned object, for example as shown in FIGS. 1 and 2, the pressure (i.e. pressurized) oil supply/discharge circuit is improved as follows.

A bypass passage 16 is connected to a pressure oil supply/discharge passage 3 in parallel with a check valve 14. A bypass opening/closing valve 17 is disposed in the bypass passage 16 and adapted to be changed over to a valve closed position X by means of a residual pressure holding spring 19 so as to hold or trap a pressure within a hydraulic actuation chamber 2 within a second pressure range $R_2$ lower than a first pressure range $R_1$ under an abnormal pressure condition in which a pressure on the side of the check valve inlet **14*a* abnormally lowers in comparison with a pressure on the side of the check valve outlet 14*b* and to a valve opened position Y against the spring 19 under a normal pressure condition in which that pressure doesn't lower abnormally. A pressure compensation valve 12 is arranged along the pressure oil supply/discharge passage 3 and a pressure oil discharge passage 7 in parallel with a pressure oil supply/discharge changeover means 4 and is adapted to hold the pressure of the hydraulic actuation chamber 2 within the first pressure range $R_1$ by discharging a flow restricted portion of the hydraulic pressure into the hydraulic actuation chamber 2**.

This first embodiment of the invention functions as follows.

Under the normal pressure condition in which a pressure at the pressure port P is within the first pressure range $R_1$, the bypass opening/closing valve 17 is changed over to the valve opened position Y by the pressure acting against the spring 19 so that the hydraulic actuation chamber 2 of the hydraulic cylinder 1 is placed in communication with the pressure compensation valve 12 through the bypass opening/closing valve 17. Thus, though the pressure within the hydraulic actuation chamber 2 may increase very slowly due to a volumetric expansion of the pressure oil caused by thermal effects at the hydraulic cylinder 1, excess hydraulic pressure is released or bled to the pressure oil discharge passage 7 through the pressure compensation valve 12. As a result, the pressure within the hydraulic actuation chamber 2 is prevented from increasing excessively.

Further, under the normal condition in which the pressure of the pressure port P is within the first range $R_1$, when a breakage of the hydraulic hose 10 and an oil leakage from the piping are caused, the pressure oil within the hydraulic actuation chamber 2 is discharged from the bypass opening/closing valve 17 at the valve opened position Y to the pressure port P. But, since the bypass opening/closing valve 17 is changed over rapidly to the valve closed position X by means of the spring 19 at the time of lowering of the pressure on the side of the check valve inlet 14*a* to the second pressure range $R_2$, the pressure lowering lower than the range pressure is prevented so as to hold the pressure of the hydraulic actuation chamber 2 within the second pressure range $R_2$.

Accordingly, this first embodiment of the invention provides the following advantages.

Though the pressure of the check valve inlet side might have abnormally decreased, it is possible to leave a pressure remaining within the hydraulic actuation chamber compatible with the prevention of an excessive pressure increase within the hydraulic actuation chamber.

Further, since the prevention of the pressure increase within the hydraulic actuation chamber can be attained by making use of the conventional pressure oil supply/-discharge circuit, it becomes possible to omit piping dedicated to a releasing of the pressure oil so that the construction of the circuit can be made simple.

Since at least two kinds of pressure ranges, namely the first pressure range and the second pressure range lower than the first pressure range are provided as the pressure within the hydraulic actuation chamber of the hydraulic cylinder, the following advantages can be provided. When the hydraulic cylinder is applied to a hydraulic clamp for a metal mould of an injection moulding machine and a hydraulic clamp for a metal mould of a press machine, since it is adapted to be changed over to a high-pressure clamping condition after completion of the mould fitting under a low-pressure clamping, the mould fitting work becomes easy. Further, when the hydraulic cylinder is used as a hydraulic clamp for work subjected to a cutting machine, since it is possible to perform a finishing process under a low-pressure clamping condition after completion of a powerful rough cutting process under a high-pressure clamping condition, machining time can be shortened and machining accuracy can be improved.

In accordance with another embodiment, a residual pressure holding valve device for use the above-mentioned pressure oil supply/discharge circuit is constructed as shown in FIGS. 7 and 8.

A pressure port P is connected in communication with a working port A through a check valve seat 28 and a check valve chamber 29 in that order within a valve casing 27. A check valve member 30 disposed within the check valve chamber 29 is resiliently urged for valve closing toward the check valve seat 28 by means of a checking spring 31. A forcibly valve-opening means (actuator) 15 of said check valve 14 is disposed outside the check valve seat 28 and a valve opening member 35 of said forcibly valve-opening means 15 is opposed to the check valve member 30 from the side of the pressure port P. The check valve member 30 is adapted to be brought into contact with the check valve seat 28 for valve closing so as to block a counter flow from the side of the check valve outlet 14*b* to the side of the check valve inlet 14*a* under a checking condition in which the forcibly valve-opening means 15 has not been operated, and the check valve member 30 is adapted to be separated from the check valve seat 28 by means of the valve opening member 35 so as to allow the pressure oil to be discharged from the working port A to the pressure port P under a checking cancelled condition in which the forcibly valve-opening means 15 has been operated.

A bypass passage 16 is arranged in a portion extending from the pressure port P to the working port A, in parallel with the check valve seat 28 and the check valve chamber 29. A bypass opening/closing valve 17 is disposed in the bypass passage 16. The bypass opening/-closing valve 17 comprises a piston valve member 38 resiliently urged against a bypass valve seat 40 by means of a residual pressure holding spring 19. The piston valve member 38 is adapted to be separated from the bypass valve seat 40 toward the residual pressure holding spring 19 by means of a pressure within the pressure port P under a normal pressure condition in which the pressure within the pressure port P is kept within a first pressure range $R_1$ and to be brought into contact with the bypass valve seat 40 for valve closing by means of the residual pressure holding spring 19 under an abnormal pressure condition when the pressure within the pressure port P abnormally lowers to a second pressure range $R_2$.

When the pressure of the pressure port P lowers from the first pressure range $R_1$ to the second pressure range $R_2$, the piston valve member 38 is brought into contact with the bypass valve seat 40 for valve closing by means of the resilient force of the residual pressure holding spring 19. Thereby, the bypass opening/closing valve 17 is changed over to the valve closed position X. Therefore, the bypass opening/closing valve 17 can be simplified in construction by omitting an opening/closing operation device.

Accordingly, when the pressure oil supply/discharge circuit with the residual pressure holding function is put into practice, the residual pressure holding valve device used for that circuit can be manufactured small in construction and inexpensively.

BRIEF DESCRIPTION OF THE DRAWINGS

The above and other important features of the present invention will be better understood from the following detailed description of a preferred embodiment of the invention, made with reference to the accompanying drawings, in which:

FIG. 1 through FIG. 8 show a first embodiment;

FIG. 1 is a circuit diagram of a pressure oil supply/-discharge circuit;

FIG. 2 is a view showing a change of a pressure within a hydraulic actuation chamber of a hydraulic cylinder over a phase of time;

FIG. 3 is a schematic view of a residual pressure holding valve device;

FIG. 4 is a circuit diagram of a hydraulic clamping device to which the present invention is applied;

FIG. 5 is a sectional view taken along the V—V directed line in FIG. 4;

FIG. 6 is a plan view of FIG. 5;

FIG. 7 is an enlarged sectional view taken along the VII—VII directed line in FIG. 5 and a cross-sectional view of the residual pressure holding valve device;

FIG. 8 is a schematic view for operational explanation. FIG. 8(*a*) is a view showing a clamping condition. FIG. 8(*b*) is a view showing a residual pressure holding condition, and FIG. 8(*c*) is a view showing a unclamping condition;

FIG. 9 shows a first variant of the aforementioned embodiment and is a partial view corresponding to FIG. 7;

FIG. 10 shows a second variant and is a schematic view corresponding to FIG. 7;

FIG. 11 shows a second embodiment and a is a view corresponding to FIG. 7;

FIG. 12 shows a third embodiment and is a view corresponding to FIG. 7;

FIG. 13 shows a fourth embodiment and is a partial view corresponding to FIG. 1;

FIG. 14 shows a fifth embodiment and is a partial view corresponding to FIG. 1;

FIG. 15 shows a sixth embodiment and is a partial view corresponding to FIG. 4;

FIG. 16 shows a seventh embodiment and is a partial view corresponding to FIG. 4.

DESCRIPTION OF THE PREFERRED EMBODIMENTS

Embodiments of the present invention will be explained with reference to the accompanying drawings hereinafter.

FIG. 1 through FIG. 8 show a first embodiment to be described below.

Firstly, both a construction and an operation of a pressure or pressurized oil supply/discharge circuit with a residual pressure holding function will be explained with reference to FIG. 1 and FIG. 2.

Figure 1:
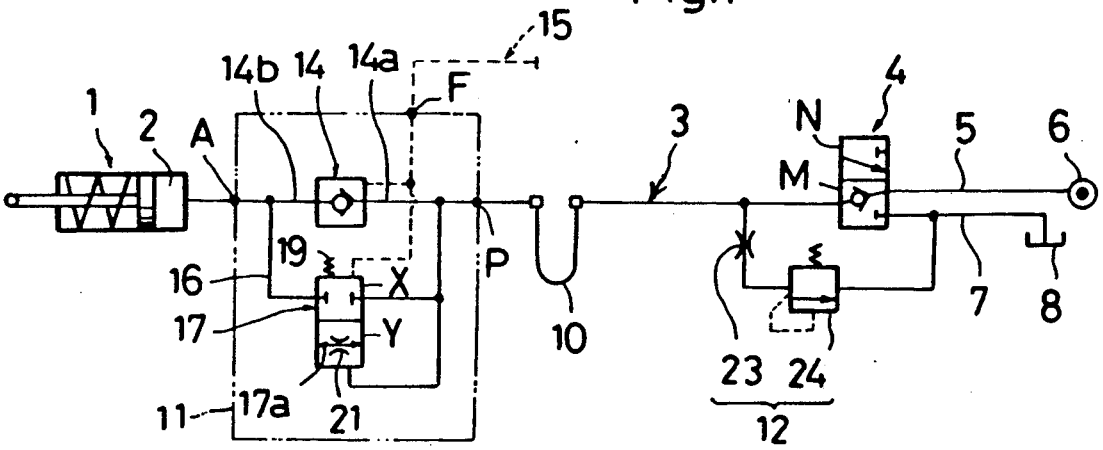
FIG. 1 through FIG. 16 show embodiments of the present invention.
Figure 2:
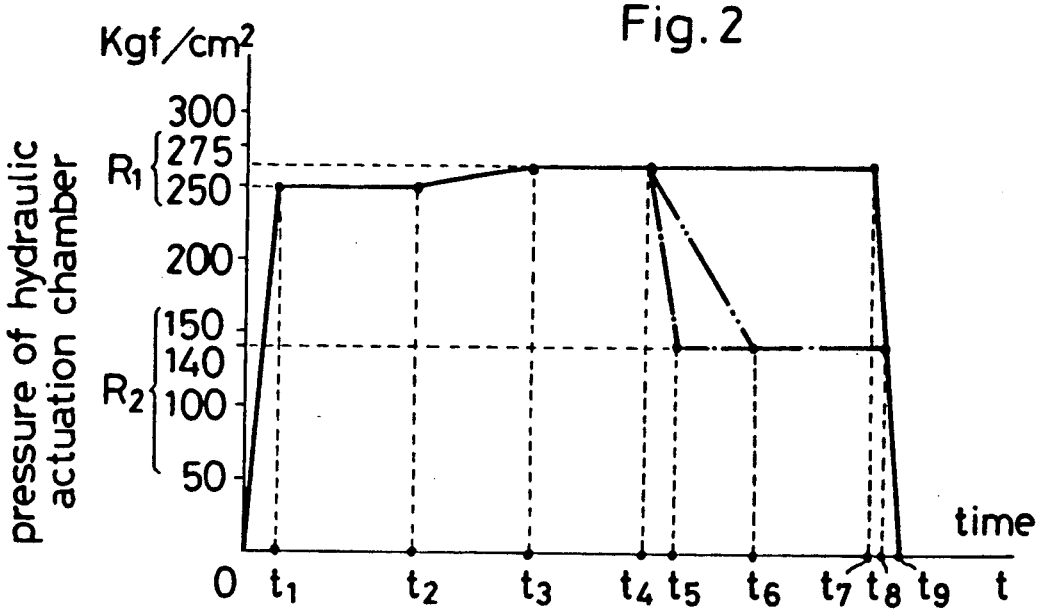

A circuit diagram of FIG. 1 shows a device for operatively extending and contracting a single-acting type spring-returned hydraulic cylinder 1.

A hydraulic actuation chamber 2 of a hydraulic cylinder 1 is adapted to be selectively connected to a hydraulic pressure source 6 at a starting end portion of a pressure (i.e., pressurized) oil supply passage 5 and to an oil tank 8 at an ending end portion of a pressure (i.e., presurized) oil discharge passage 7 through a pressurized oil supply/discharge passage 3 and a pressurized oil supply/dishcarge changeover means 4. The pressurized oil supply/discharge changeover means 4 is composed of one changeover valve and adapted to be changed over to a supply position M and to a discharge position N. A residual pressure holding valve device 11 is disposed between the hydraulic actuation chamber 2 and a hydraulic hose 10 of the pressure oil supply/discharge passage 3. A pressure compensation valve 12 is arranged along the pressurized oil supply/discharge passage 3 and the pressurized oil discharge passage 7 in parallel with the pressurized oil supply/discharge changeover means 4.

The residual pressure holding valve device 11 is provided with a check valve 14 with a forcibly valve-opening (actuating) function, a forcibly valve-opening (actuator) means 15 of the fluid-pressure operating type, a bypass passage 16 connected in parallel with the check valve 14 and a bypass opening/closing valve 17 disposed in the bypass passage 16. The bypass opening/-closing valve 17 is adapted to be changed over to a valve closed position X by means of a residual pressure holding spring 19 when pressure is not acting on the side of the check valve inlet 14*a* and to a valve opened position Y by means of a pressure on the side of the check valve inlet 14*a* against the residual pressure holding spring 19. A flow restrictor means 21 composed of a throttling passage is disposed in a valve passage 17*a* of the bypass opening/closing valve 17.

The pressure compensation valve 12 comprises a throttling valve 23 and a relief valve 24 connected in series with each other.

The operation of the aforementioned pressure oil supply/discharge circuit will be explained with reference to FIG. 1 and FIG. 2.

At the time of extending operation of the hydraulic cylinder 1, the changeover means 4 is changed over to the supply position M and the forcibly valve-opening actuator means 15 is changed over to the fluid discharge position. Thereupon, pressurized oil from the hydraulic pressure source 6 flows into the hydraulic actuation chamber 2 through the pressure port P, the check valve inlet 14*a*, its outlet 14*b* and a working port A of the valve device 11 so as to operatively extend the hydraulic cylinder 1. The pressure of the hydraulic actuation chamber 2 increases gradually as the extension resistance increases, and when it has reached the pressure (herein, 250 Kgf/cm$^2$) of the first pressure range $R_1$ of substantially the same pressure as that of the hydraulic pressure source 6, the extension of the hydraulic cyliner 1 is completed (time $t_1$). Midway while pressure is increasing on the side of the check valve inlet 14*a*, the bypass opening/closing valve 17 is changed over to the valve opened position Y so that the hydraulic actuation chamber 2 is connected in communication with the pressure compensation valve 12 through the bypass opening/closing valve 17.

Upon completion of extension, when the hydraulic cylinder 1 absorbs heat from outside, the pressure of the hydraulic actuation chamber 2 starts to increase very slowly dur to a volumetric expansion of the pressure oil (time $t_2$). When the pressure has increased to a set pressure (herein, around 255~270 Kgf/cm$^2$) of the relief valve 24 (time $t_3$), the pressure compensation valve 12 serves to discharge (i.e., bleed) only the very slowly increased portion of the hydraulic pressure from the pressure oil discharge passage 7 to the oil tank 8. Thereby, the pressure of the hydraulic actuation chamber 2 is held within the first pressure range $R_1$.

Under the extended condition of the hydraulic cylinder 1, when the pressure of the pressure port P starts to drop rapidly abnormally due to a breakage of the hydraulic hose 10 and the like (time $t_4$), the pressure of the hydraulic actuation chamber 2 lowers (refer to the figure indicated by the alternate long and short dash line) because the check valve 14 serves to block a counter flow from the side of the check valve outlet 14*b* to the side of the check valve inlet 14*a* and at the same time, the bypass opening/closing valve 17 at the valve opened position Y serves to allow the pressure oil to discharge from the sorking port A to the pressure port P. When the pressure of the pressure port P lowers to the pressure (herein, 140 Kgf/cm$^2$) within the second pressure range $R_2$ (time $t_5$), the bypass opening/closing valve 17 is changed over to the valve closed position X by means of the residual pressure holding spring 19. Thereby, the pressure of the hydraulic actuation chamber 2 is held within the second pressure range $R_2$. Further, if the pressure of the pressure port P starts to abnormally lower very slowly due to a little leak from the piping and the like at the time of $t_4$, the pressure in the hydraulic actuation chamber 2 lowers very slowly (refer to the figure indicated by the alternate long and two short dashes line). Thereupon, similarly to the aforementioned case, when the pressure of the pressure port P lowers to the pressure within the second pressure range $R_2$ (time $t_6$), the bypass opening/closing valve 17 is changed over to the valve closed position X so that the pressure of the hydraulic actuation 2 can be held within the second pressure range $R_2$.

On one hand, under such a condition that the pressure of the hydraulic actuation chamber 2 is held within the first pressure range $R_1$, when the hydraulic cylinder 1 is operatively contracted, the pressure oil supply/discharge changeover means 4 is changed over to the discharge position N and the forcibly valve opening means 15 of the fluid pressure type is changed over to the supply position (time $t_7$). Thereupon, the checking condition of the check valve 14 is canceled so that the pressure oil within the hydraulic actuation chamber 2 is discharged to the oil tank 8 through the working port A, the check valve outlet 14*b*, the check valve inlet 14*a*, the pressure port P and the changeover means 4 at the discharge position N in that order. Contemporaneously, the pressure of the hydraulic actuation chamber 2 lowers rapidly, and the contraction of the hydraulic cylinder 1 is completed (time $t_9$).

Incidentally, the contracting operation of the hydraulic cylinder 1 may be performed according to the following procedure. Under such a condition that the pressure of the hydraulic actuation chamber 2 is held within the first pressure range $R_1$, firstly only the changeover means 4 s changed over to the discharge position N at the time of $t_4$. Thereupon, the pressure oil within the hydraulic actuation chamber 2 is discharged from the bypass opening/closing valve 17 at the valve opened position Y so that the pressure of the hydraulic actuation chamber 2 lowers to the second pressure range $R_2$ (time $t_5$). Under this condition, the check valve 14 is opened (time $t_8$) by operating the forcibly valve opening means 15 to the supply position. Thereby, the pressure of the hydraulic actuation chamber 2 lowers, so that the contraction of the hydraulic cylinder 1 is completed (time $t_9$).

Next, the construction of the aforementioned residual pressure holding valve device 11 will be schematically explained.

Figure 3:
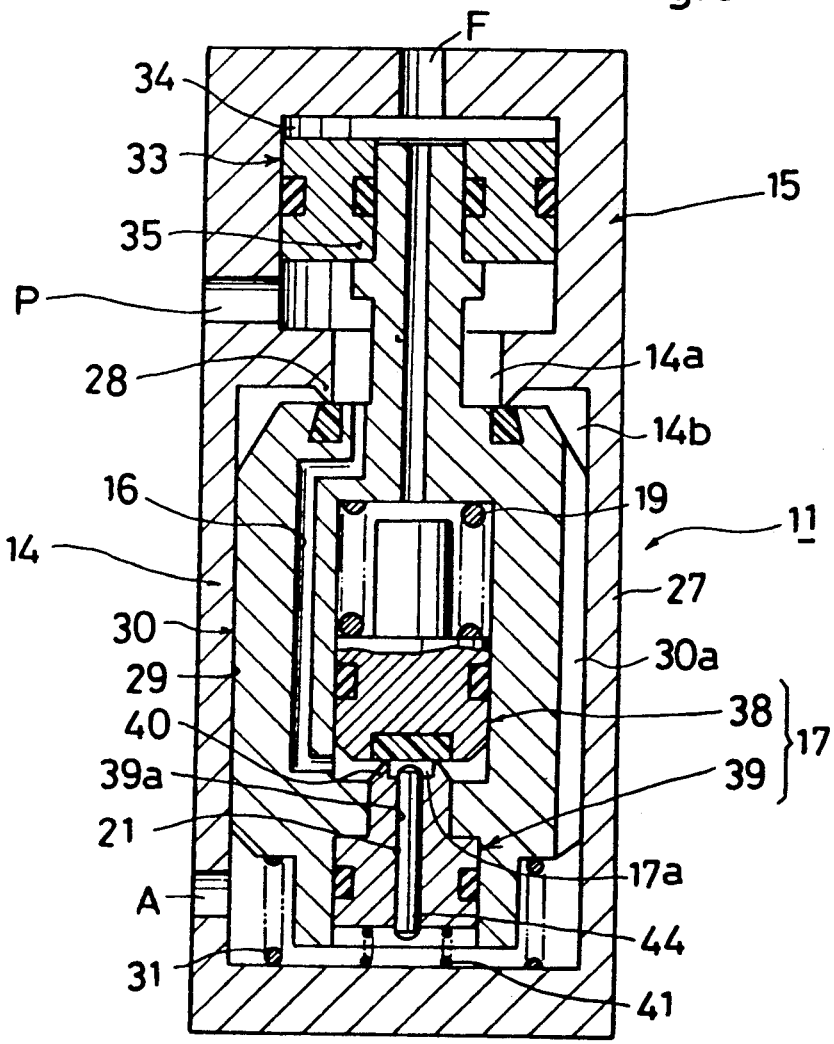

As shown in FIG. 3, the pressure port P is connected in communication with the working port A through the check valve seat 28 and the check valve chamber 29 in that order within the valve casing 27. The check valve member 30 disposed within the check valve chamber 29 is resiliently urged for valve closing toward the check valve seat 28 by means of the checking spring 31.

The forcibly valve-opening means 15 is disposed outside (near the top in FIG. 3) both the pressure port P and the check valve seat 28 and is provided with a fluid pressure piston 33 disposed in the valve casing 27. Above the fluid pressure piston 33 there are provided a fluid pressure actuation chamber 34 and pilot port F. A valve opening member 35 disposed below the piston 33 is opposed to a check valve member 30 from the side of the pressure port P.

Further, a bypass passage 16 is arranged along a portion from the pressure port P to the working port A in parallel with the check valve seat 28 and the check valve chamber 29. Incidentally, the bypass passage 16 may be formed in a wall of the valve casing 27 or outside the valve casing 27 instead of within the check valve member 30 in this embodiment.

The bypass opening/closing valve 17 disposed in a central portion of the bypass passage 16 is provided with a piston valve member 38 and a valve seat tube 39 having a bypass valve seat 40. The piston valve member 38 and valve seat tube 39 are inserted into the check valve member 30 so as to be oil-tightly movable within a certain extent and are resiliently urged towards valve closing by means of the residual pressure holding spring 19 and a return spring 41. A flow resistance application (restrictor) means 21 arranged in the bypass passage 16 is constructed by an annular fitting or clearance gap formed between a tube port 39*a* of the valve seat tube 39 and a throttling valve member 44 inserted into the tube port 39*a*.

Under the normal pressure condition in which the pressure of the pressure port P is within the first pressure range $R_1$, the aforementioned piston valve member 38 is separated from the bypass valve seat 40 by means of pressure in the $R_1$ range against the residual pressure holding spring 19. Thereby the working port A is connected in communication to the pressure port P so that a very slowly increased portion of the hydraulic pressure at the working port A is released to the pressure port P. To the contrary, under the abnormal pressure condition in which the pressure of the pressure port P has lowered abnormally to the second pressure range $R_2$, the piston valve member 38 is brought into contact with the bypass valve seat 40 for valve closing by means of the residual pressure holding spring 19. Thereby, the pressure of the working port A can be held within the second pressure range $R_2$.

When a pressure fluid is supplied from the pilot port F to the fluid pressure actuation chamber 34, the fluid pressure piston 33 serves to separate the check valve member 30 from the check valve seat 28 through the valve opening member 35 so that the pressure oil at the working port A is discharged to the pressure port A through a peripheral groove 30*a* on the check valve member 30.

Several physical embodiments of the aforementioned pressure oil supply/discharge circuit and the residual pressure holding valve device 11 will be explained with reference to FIG. 4 through FIG. 8 hereinafter.

Figure 4:
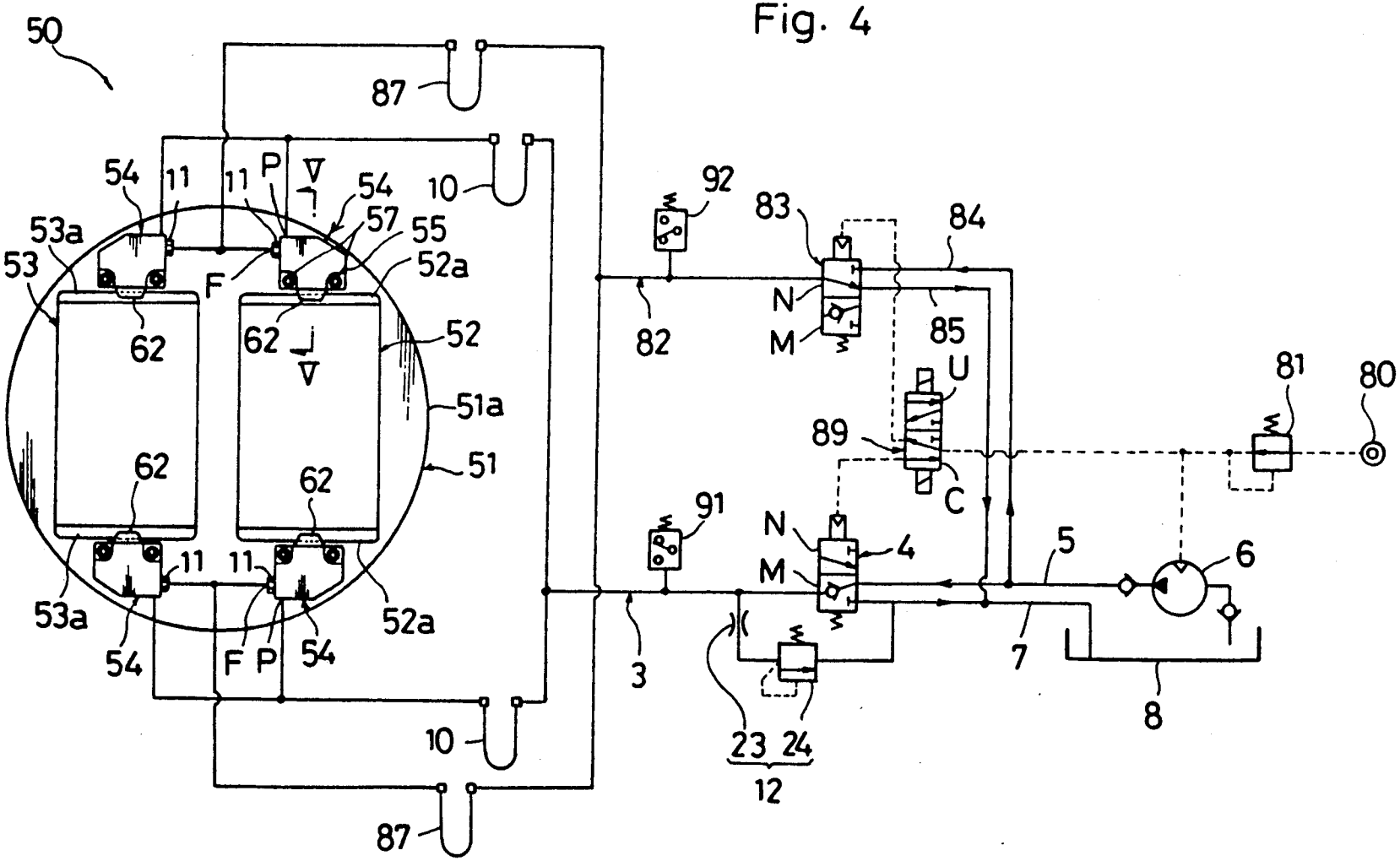

FIG. 4 shows a hydraulic clamping device 50 for fixing a metal mould to an injection moulding machine of the rotary table type.

A first metal mould 52 and a second metal mould 53 are fixedly secured to a circular rotary table 51 of an injection moulding machine by means of two hydraulic clamps 54, 54 respectively. Each hydraulic clamp 54 is fixedly secured at opposite side walls of its housing 55 to a rotary table frame 51 by means of bolts 57, 57. Respective clamping members 62 extended from the housings 55 are adapted to press upper and lower fixed portions 52*a*, 53 *a* of the respective metal moulds 52, 53.

These hydraulic clamps 54 are adapted to actuate the clamping members 62 forward and backward in the inclined direction with respect to the metal moulds 52, 53 in order to enable them to be mounted within an outer peripheral surface 51*a* of the rotary table frame 51.

Figure 6:
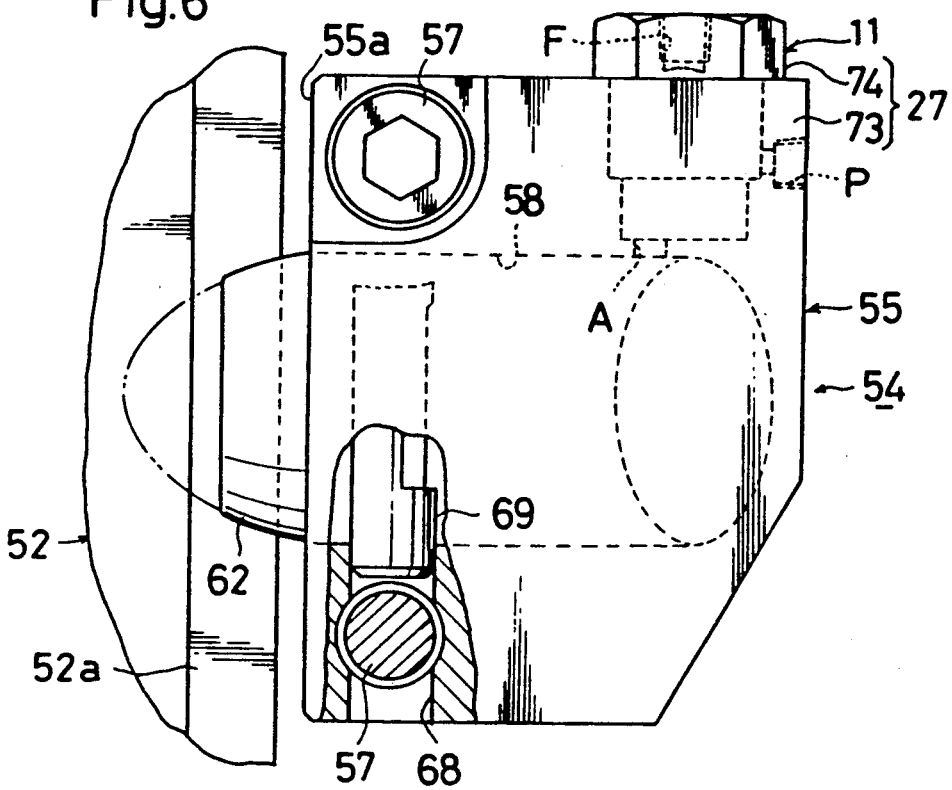
Figure 5:
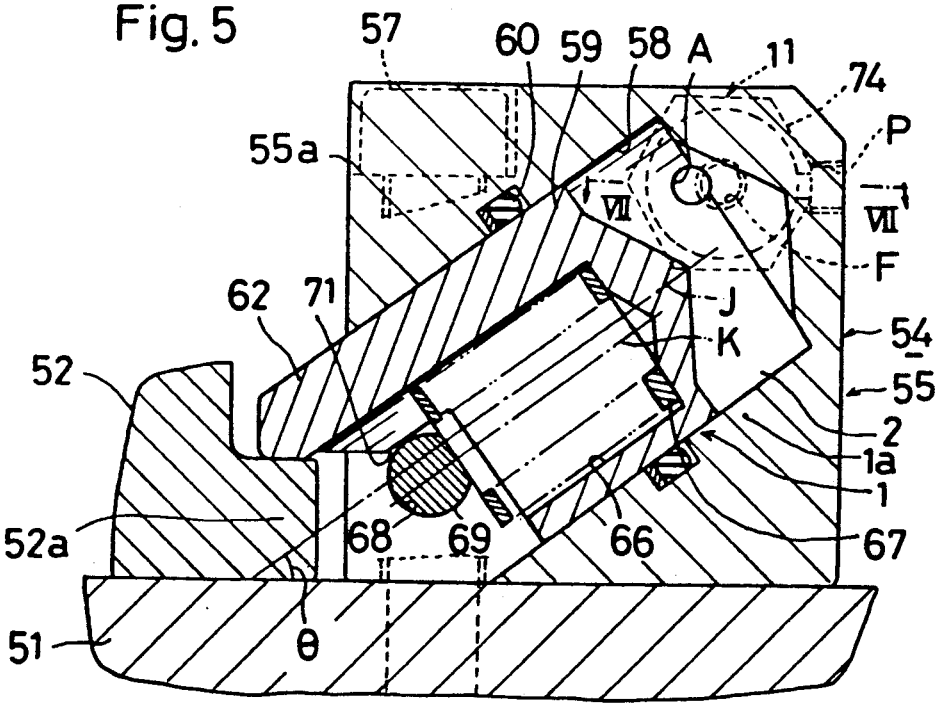

That is, as shown in a vertical section view of FIG. 5 and in a plan view of FIG. 6, a cylinder bore 58 of a hydraulic cylinder 1 is formed within the housing 55 of a hydraulic clamp 54 in the forwardly downwardly inclined manner. An inclination angle $\theta$ of the cylinder bore 58 is preferably defined at ab. 35 degree for providing a compact construction of the housing 55. A hydraulic piston 59 is inserted into the cylinder bore 58 through a packing 60 so as to be oil-tightly movable forwardly and backwardly. The hydraulic actuation chamber 2 is formed within the cylinder bore 58 so as to face the back surface of the piston 59 to the advancing side thereof.

A spring accommodation bore 66 is formed in the piston 59 so as to extend backwardly from its front surface. An axis K of the spring accommodation bore 66 is offset to the lower side relative to an axis J of the piston 59. An unclamping spring 67 composed of a compression spring is accommodated within the spring accommodation bore 66. This unclamping spring 67 is moulded between the piston 59 and a spring retaining pin 69 inserted into a pin insertion hole 68 of the housing 55. A pair of left and right free travel grooves 71, 71 are formed in the opposite lateral side portions of the clamping member 62 in such a manner as to open their front surfaces in order to avoid an interference with the spring retaining pin 69.

When the hydraulic clamp 54 is changed over to the illustrated clamping condition, the pressure oil is supplied to the hydraulic actuation chamber 2. Thereupon, the piston 59 is forwardly actuated by means of the hydraulic pressure, so that the clamping member 62 is advanced to the clamping position outside the front surface 55*a* of the housing 55. Thereby, the clamping member 62 serves to press and fix the fixed portion 52*a* of the metal mould 52 onto the rotary table frame 51.

In the housing 55 of the aforementioned hydraulic clamp 54 there is provided the residual pressure holding valve device 11.

Figure 7:
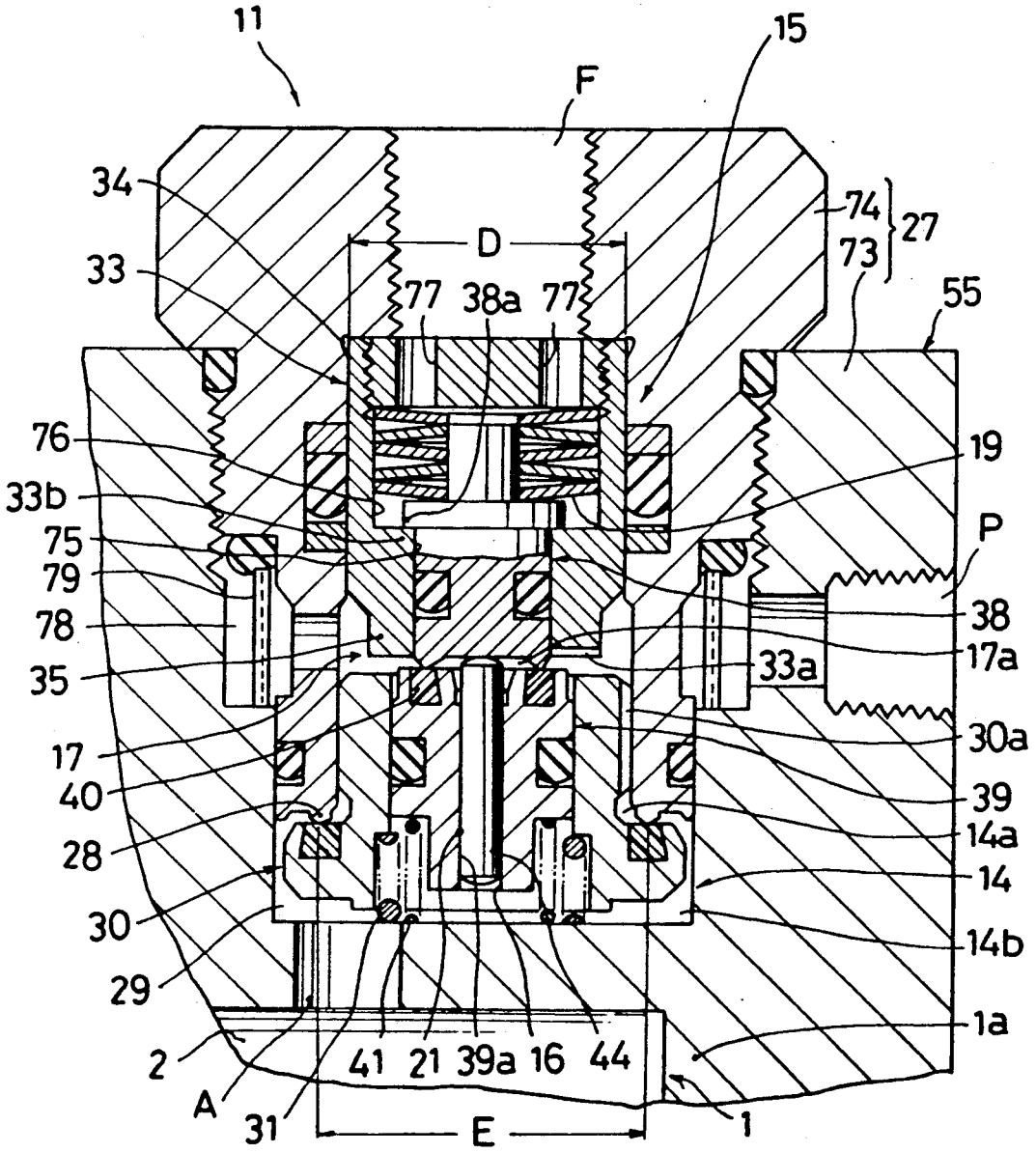

As shown in FIG. 7, the casing 27 of the valve device 11 comprises a wall portion 73 and a cover bolt 74 of the housing 55. The pressure port P of the valve device 11 is formed in the housing wall portion 73, the working port A is connected in communication to the hydraulic actuaction chamber 2, and the pilot port F is formed in the cover bolt 74.

The check valve seat 28 of the check valve 14 is formed in the leading end portion (in the lower end portion in Figure) of the cover bolt 74. The check valve chamber 29 is formed in the space below the cover bolt 74. The check valve member 30 is guided within the leading end portion of the cover bolt 74. The valve surface of the check valve member 30 is made of a resilient material such as fluororesin and the like.

The valve seat tube 39 of the bypass opening/closing valve 17 is inserted oil-tightly and movably into the check valve member 30. A bypass valve seat 40 is formed in the upper portion of the valve seat tube 39. Also the bypass valve seat 40 is made of a resilient material such as fluororesin and the like.

The fluid pressure piston 33 of the forcibly valve-opening means 15 is inserted into the central portion of the cover bolt 74 coaxially with the check valve member 30. The fluid pressure piston 33 has a piston pressure receiving sectional area that is smaller than the pressure non-receiving sectional area within the check valve seat 28 by defining its external dimension D smaller than a cut-off diameter dimension E of the check valve seat 28. A piston valve member accommodation bore 75, a spring chamber 76 and communication ports 77 are formed in order within the fluid pressure piston 33. The piston valve member 38 oil-tightly and movably inserted into the accommodation bore 75 is resiliently urged for valve closing toward the bypass valve seat 40 by means of the residual pressure holding spring 19 mounted within the spring chamber 76. Its valve closing movement further than a predetermined sistance is blocked by the contact between a shoulder portion 38*a* of the piston valve member 38 and a reduced diameter stopper portion 33*b* of the fluid pressure piston 33. An annular filter chamber 78 is formed between the pressure port P and the bypass opening/closing valve 17 as well as the check valve 14. An annular primary filter 79 is mounted within the filter chamber 78.

The operation of the aforementioned valve device 11 will be explained with reference to FIG. 8.

Figures 8A, 8B, 8C:
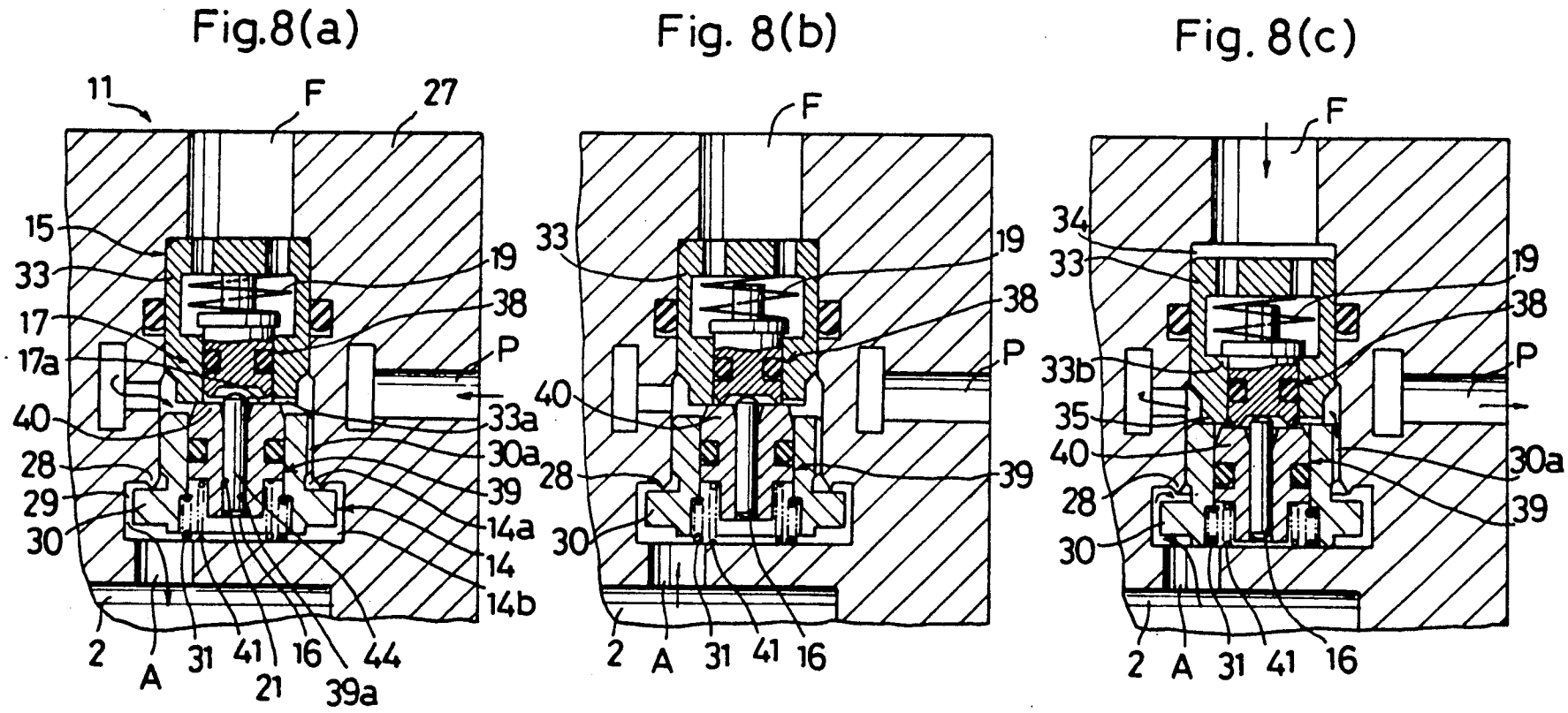

FIG. 8 (A) shows the clamping condition. At the time of clamping operation, the pressure (i.e., pressurized) oil supplied from the pressure port P serves to push and open the check valve member 30 and flows into the hydraulic actuation chamber 2 through the working port A. After the pressure within the hydraulic actuation chamber 2 has increased, the check valve member 30 is brought into contact with the check valve seat 28 for valve closing by means of the checking spring 31. The valve seat tube 39 urged by means of the return spring 41 is received by the fluid pressure piston 33. The piston valve member 38 is kept separated from the bypass valve seat 40 against the residual pressure holding spring 19 by means of the pressure acting in the bypass passage 16. Thereby, the working port A is connected in communication to the pressure port P through the flow resistance application (restrictor) means 21 composed of the fitting (clearance) gap, the valve passage 17*a* and the communication groove 33*a* of the fluid pressure piston 33 in order.

FIG. 8(*b*) shows the residual pressure holding condition. In case that the pressure within the pressure port P abnormally lowers, the check valve member 30 is held in such a condition that it is kept in contact with the check valve seat 28 for valve closing and the residual pressure holding spring 19 urges the piston valve member 38 into contact with the bypass valve seat 40 so that the pressure within the hydraulic actuation chamber 2 can be maintained.

FIG. 8(*c*) shows the unclamping condition. By supplying the pressure fluid to the pilot port F, the fluid pressure piston 33 servies to separate the check valve member 30 from the check valve seat 28 through the valve opening member 35. Thereby, the pressure oil within the hydraulic actuation chamber 2 is discharged from the pressure port P. In this case, a resultant force composed of the resilient force of the residual pressure holding spring 19 and the received pressure from the pilot port F acts on the piston valve member 38 while the piston valve member 38 is received by the check valve member 30 through the stopper portion 33*b* of the fluid pressure pistion 33. Thereby, a sufficient valve-closing contact force for the piston valve member 38 and the valve seat tube 39 is provided by the resilient force only of the return spring 41. As a result, the bypass valve seat 40, which is made of a resilient mateial, becomes hardly damaged and can have a long service life.

Figure 17:
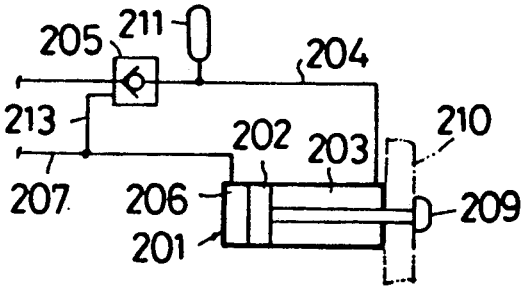
Fig. 17 PRIOR ART
FIG. 17 shows a conventional embodiment and is a partial view corresponding to FIG. 1.

Further, since the valve surface of the check valve member 30 and the bypass valve seat 40 are made of a resilient material, oil leakage can be prevented more surely. As a result, the accumulator 211 employed in the conventional embodiment (refer to FIG. 17) can be omitted, so that whole of the valve device 11 can be made small. Incidentally, the location where a sealing resilient member is arranged may be the check valve seat 28 and the valve surface of the piston valve member 38.

As shown in FIG. 4, the pressure port P of each aforementioned valve device 11 is selectively connected to the booster pump (the hydraulic pressure source) 6 at the starting end portion of the pressure oil supply passage 5 and to the oil tank 8 at the ending end portion of the pressure oil discharge passage 7 through the pressure oil supply/discharge passage 3 and the pressure oil supply/discharge changeover means 4. The booster pump 6 is adapted to operatively deliver oil from the oil tank 8 when compressed air is supplied from a pneumatic source 80 thereto through a pressure reduction valve 81. In the central portion of the pressure oil supply/discharge passage 3 there are provided two flexible hydraulic hoses 10, 10, and the pressure compensation valve 12 is disposed along the pressure oil supply/discharge passage 3 and the pressure oil discharge passage 7 in parallel with the pressure oil supply/discharge changeover means 4.

The pilot port F of each valve device 11 is selectively connected to a pressure fluid supply passage 84 and to a pressure fluid discharge passage 85 through a pressure fluid supply/discharge passage 82 and a pressure fluid supply/discharge changeover means 83. The pressure fluid supply/discharge changeover means 83 employs a hydraulic changeover valve having the same construction as that of the pressure oil supply/discharge changeover means 4. The pressure fluid supply passage 84 is connected to the pressure oil supply passage 5, and the pressure fluid discharge passage 85 is connected to the pressure oil dischanrge passage 7. Also in the central portion of the pressure fluid supply/discharge passage 82 there are provided towo flexible hoses 87, 87.

The aformentioned two changeover means 4, 83 are changed over to the supply position M and the discharge position N by means of an electromagnetic pneumatic changeover valve 89. When the pneumatic changeover valve 89 is changed over to the clamping position C, the pressure oil supply/discharge changeover means 4 is changed over to the supply position M and the pressure fluid supply/discharge changeover means 83 is changed over to the discharge position N. Thereby, the pressure oil of the booster pump 6 is supplied to the pressure port P of the valve device 11 so that four hydraulic clamps 54 are actuated for clamping. This clamping operational condition is detected by means of a pressure swith 91. On the other hand, when the pneumatic changeover valve 89 is changed over to the unclamping position U, the pressure oil supply/discharge changeover means 4 is changed over to the discharge position N and the pressure fluid supply/discharge changeover means 83 is changed over to the supply position M. Thereby,, the pressure oil of the booster pump 6 is supplied to the pilot port F of the valve device 11. As a result, the pressure oil within the hydraulic actuation chamber 2 is discharged from the pressure port P to the oil tank 8 through the changeover means 4 so that the respective hydraulic clamps 54 are acturated for unclamping. This unclamping operational condition is detected by means of a pressure switch 92.

As described above, since the forcibly valve-opening means (actuator) 15 of the chack valve 14 is constructed as a fluid pressure actuating type, the automation of the changeover of the pressured oil supply/discharge circuit 3 becomes easy. By constructing the forcibly valve-opening means 15 as a hydraulic actuating type, the fluid pressure piston 33 for valve opening operation can be made small in dimension and the whole of the device can be made small.

Further, since the flow resistance application means (restrictor) 21 is arranged in series with respet to the valve passage 17*a* of the bypass opening/closing valve 17, even through the pressure drop on the side of check valve inlet 14*a* is abrupt, the rate of pressure drop in the hydraulic acturation chamber 2 can be made slow by means of the flow resistance application means 21 so that the residual pressure in the hydraulic actuation chamber 2 can be sustained at a high level.

FIG. 9 through FIG. 16 show variants and other embodiments respectively. Incidentally, in the respective variants and embodiments, component parts having the same constructions as those of the first embodiment are designated by the same symbols generally.

Figure 9:
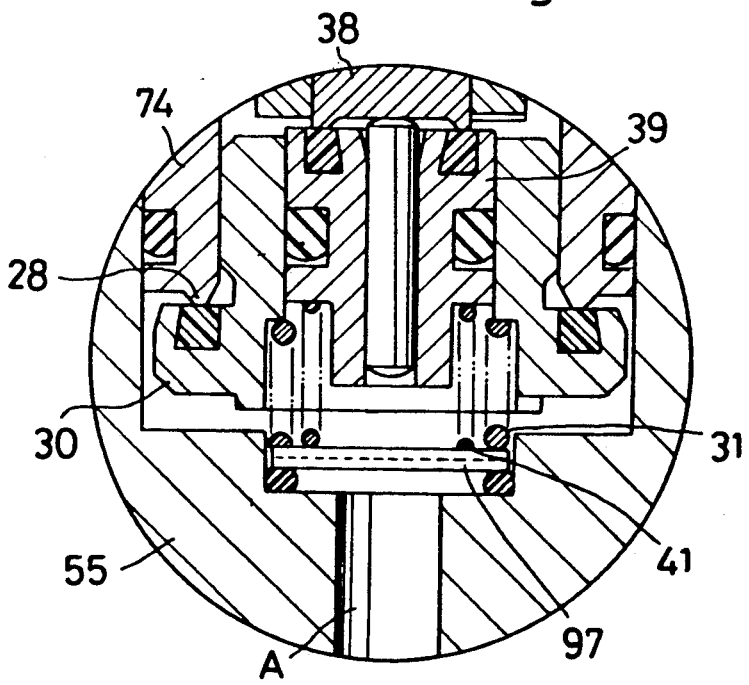

FIG. 9 shows a frist variant of the above-memtioned first embodiment. Onto a portion facing the working port A within the housing 55, a second filter 97 is pressed and fixed oil-tightly by means of the resilient forces of the checking spring 31 and the return spring 41.

Figure 10:
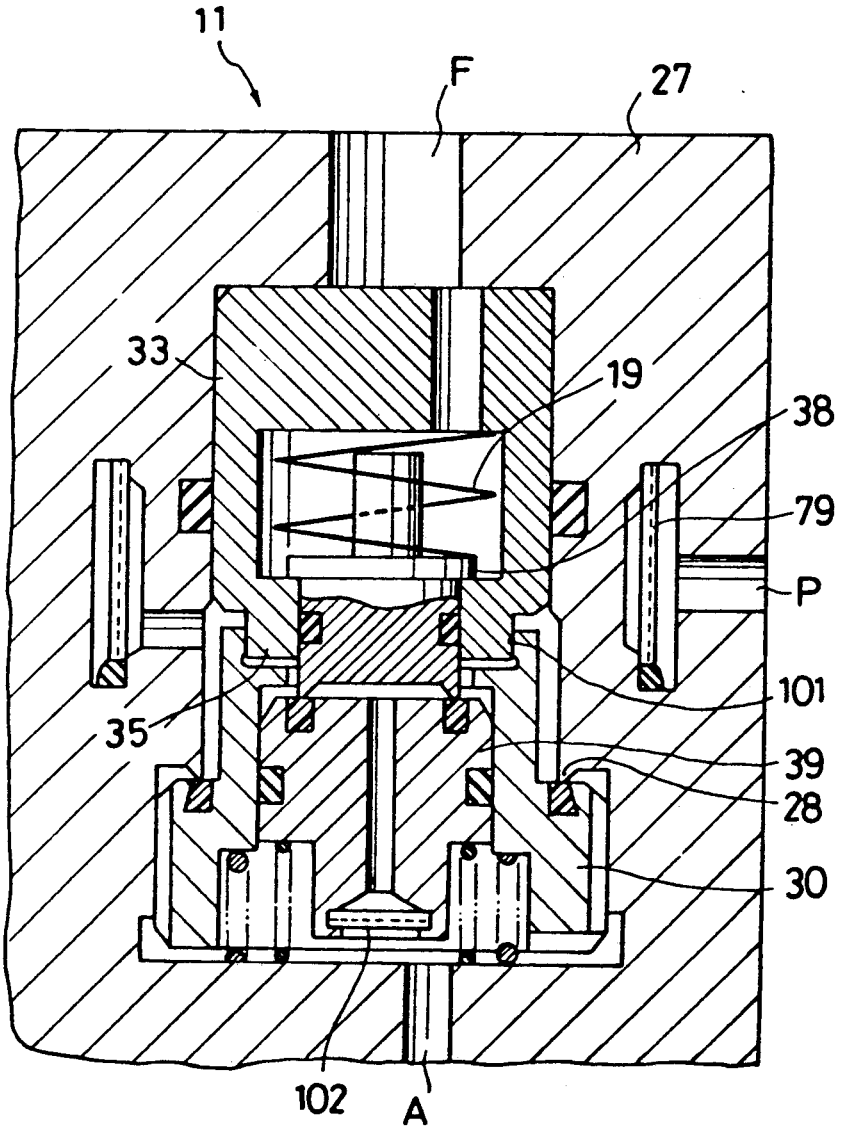

FIG. 10 shows a second variant of the first embodiment. A flow resistance application means (flow restrictor) 101 is composed of an annular fitting (clearance) gap formed between the check valve member 30 and the fluid pressure piston 33. A secondary filter 102 is fixedly secured to the lower portion of a cylindrical port of the valve seat tube 39.

Figure 11:
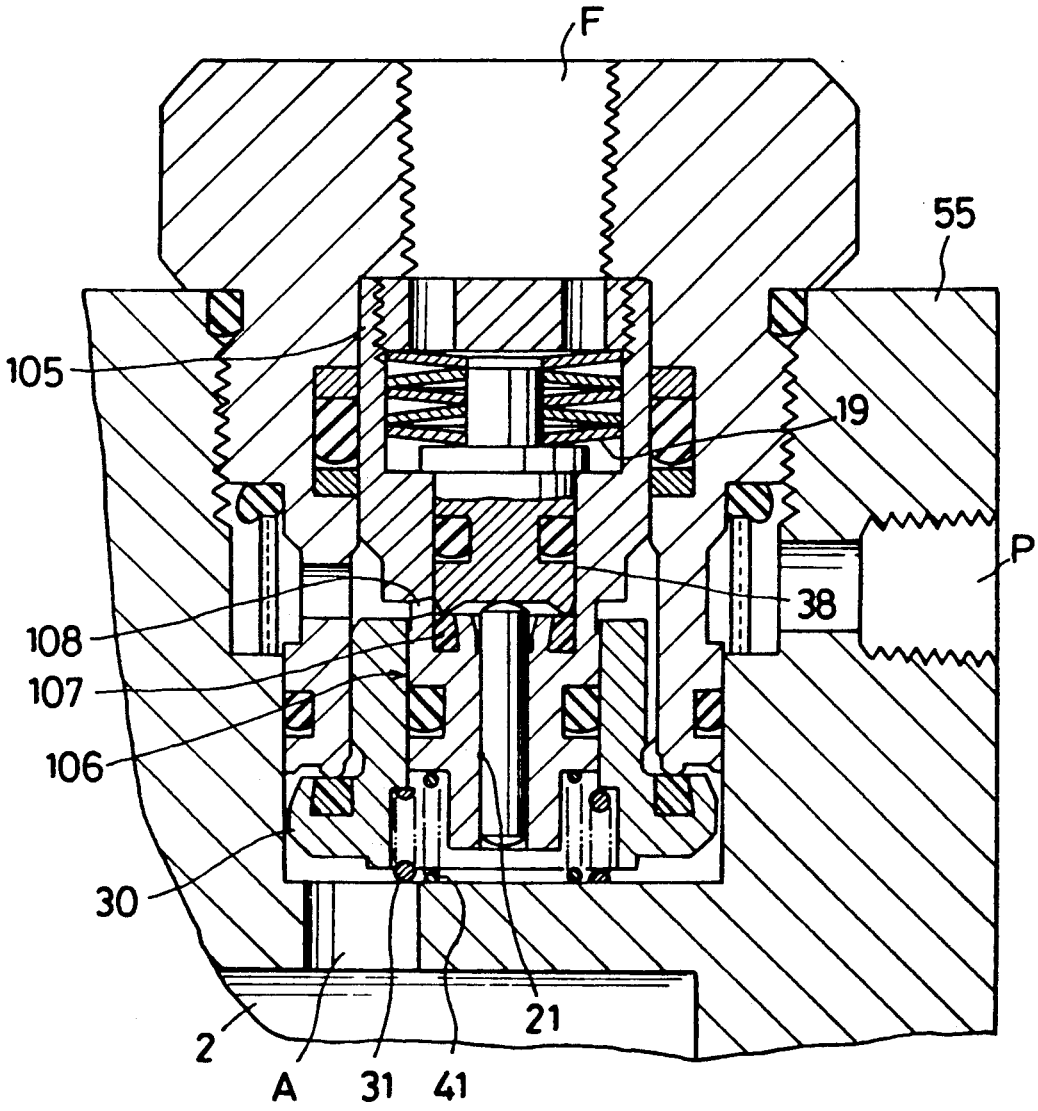

FIG. 11 shows a second embodiment of the invention

A hydraulic piston 105 and a valve seat tube 106 are integrally formed, and a bypass valve seat 107 is disposed in the midway (central) portion of the cylindrical port of this integrated tube. The working port A is adapted to be connected in communication to the pressure port P through the flow resistance application means 21 and a communication port 108 above the bypass valve seat 107 in order.

Figure 12:
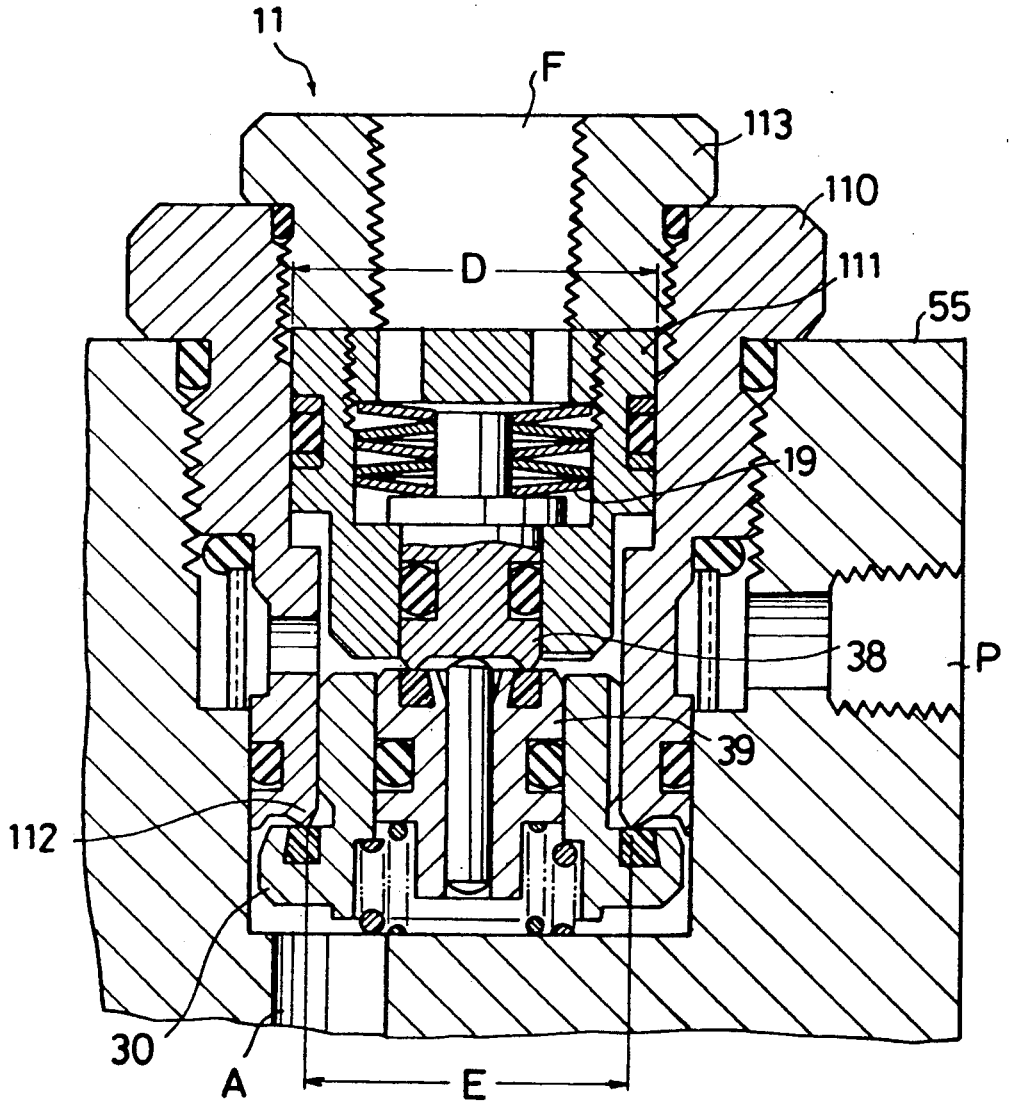

FIG. 12 shows a third emboiment of the invention.

A fluid pressure piston 111 inserted into a cover bolt 110 has its external dimension D defined at a larger valve than a cut-off diameter E of a check valve seat 112. The fluid pressure piston 111 is asapted to be secured by means of a press (i.e., locking) bolt 113 within the cover bolt 110. According to this construction, since the pressue received by the fluid pressure piston 111 can be made large at the time of unclamping operation, the check valve member 30 can be opened powerfully (with substantial force).

Figure 13:
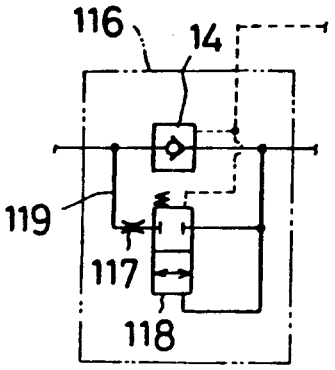

FIG. 13 shows a fourth embodiment of the invention.

A flow resistance application means (restrictor) 117 of a residual pressure holding valve device 116 is disposed in a bypass passage 119 outside a bypass opening/closing valve 118.

Figure 14:
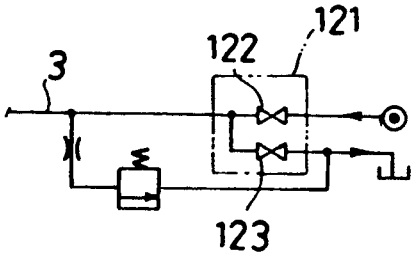

FIG. 14 shows a fifth emnbodiment of the invention.

A pressure oil supply/discharge changeover means 121 comprises two valves, namely a supply opening/closing valve 122 and a discharge opening/closing valve 123. When a pressure oil is supplied to the pressure oil supply/discharge passage 3, the supply opening/closing valve 122 is opened and the discharge opening/closing valve 123 is closed. When the pressure oil is discharged from the pressue oil supply/discharge passage 3, the supply opening/closing valve 122 is closed and the discharge opening/closing valve 123 is opened.

Figure 15:
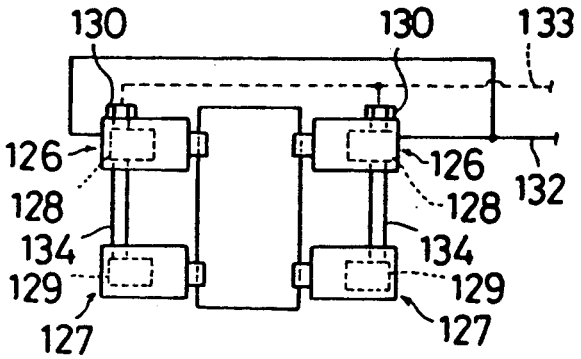

FIG. 15 shows a sixth embodiment of the invention.

Residual pressure holding valve devices 130 are fixedly secured to respective hydraulic actuation chambers 128 of hydraulic clamps 126, 126 on one side two pairs of hydraulic clamps, and a pressure oil supply/discharge passage 132 and a pressure fluid supply/device passage 133 are connected to each valve device 130.

Respective hydraulic actuation chambers 129 of hydraulic clamps 127, 127 on the other side are connected in communicaion with the respective hydraulic actuation chambers 128 on one side through communicaion pipes 134 respectively.

Figure 16:
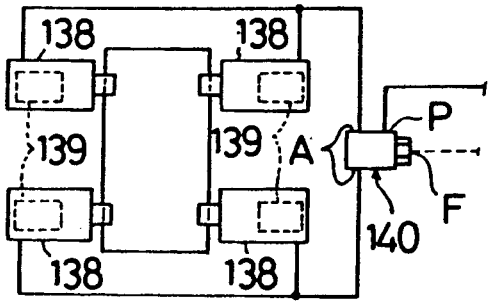

FIG. 16 shows a seventh embodiment o the invention.

Respective hydraulic actuation chambers 139 of four hydraulic clamps 138 are connected to one residual pressure holding valve device 140. This valve device 140 is provided with one pressure port P, one pilot port F and two working ports A.

Incidentally, besides the above-mentioned variants and embodiments, the present invention may be modified as follows.

(a) the hydraulic clamp is not limited to the tye wherein the clamping member is actuated in the inclined direction, but rather may be employed in other kinds of devices such as a press machine and the like.

(b) The forcibly valve-opening means (actuator) 15 of the check valve 14 may be of the pneumatically or manually operated type instead of the hydraulically operated type.

(c) The hydraulic cylinder may be of the double-acting type instead of the single-acting type.

(d) The flow resistance application means 21 interposed in the bypass passage 16 may be composed of a prot having a small diameter instead of the annular fitting clearane gap. Further, the flow resistance application means 21 may omitted by increasing the speed of the valve closing operation of the bypass opening/closing valve 17.

(e) The presure compensation valve may be one that releases a very slowly increasing portion of the pressure which might be caused by a cubical (volumetric) expansion of the pressure oil and may be of a different type having such a function instead of a combined throttle valve and relief valve.

As many different embodiments of the invention will be obvious to those skilled in the art, some of which have been disclosed or referred to herein, it is to be understood that the specific embodiments of the present invention as presented herein are intended to be by way of illustration only and not to limit the invention. It is to be understood that various embodiments, changes, or modifications may be made without departing form the spirit and scope of the invention as set forth in the claims appended herein.

What is claimed is:

1. A pressurized oil supply/discharge circuit including a hydraulic actuation chamer (2) in a hydraulic cylinder (1), said hydraulic actuaion chamber (2) being adapted to be selecively connected to a pressurized oil supply passage (5) and to a pressurized oil discharge passage (7) through a pressurized oil supply/discharge passage (3) and a pressurized oil supply/discharge changeover means (4), said circuit comprising:

a check valve (14) disposed in said pressurized oil supply/discharge passage (3), said check valve (14) having an inlet **(14*a*) connected in communication with said pressurized oil supply/discharge changeover means (4) and an outlet (14*b*) connected in communication with said hydraulic actuation chamber (2)**;

a valve-opening actuator means (15) adapted to allow a counter flow from the outlet **(14*b*) of said check valve (14) to the inlet (14*a*) thereof by, forcibly opening said check valve (14)**;

a bypass passage (16) connected to said pressurized oil supply/discharge passage (3) is parallel with said check valve (14);

a bypass opening/closing valve (17) having a residual pressure holding spring (19) and being disposed in said bypass passage (16) and adapted to be changed over to a valve closed position (X) by said spring (19) so as to hold a pressure of said hydraulic actuation chamber (2) within a second pressure range ($R_2$) lower than a first pressure range ($R_1$) under an abnormal pressure condition in which a pressure on the check valve inlet **(14*a*) side is abnormally low in comparison with a pressure on the check valve outlet (14*b*) side and to a valve opened positon (Y) against said spring (19) under a normal pressure condition in which said pressure on said check valve inlet side is not abnormally low; and a pressure compensation valve (12) arranged along said pressurized oil supply/discharge passage (3) and said pressurized oil discharge passage (7) in parellel with said pressurized oil supply/discharge chargeover means (4), said valve (12) being adapted to hold the pressure of said hydraulic actuation chamber (2) within the first pressure range ($R_1$) by discharging only a very slowly increased portion of the hydraulic pressure within said chamber (2)**.

2. A pressurized oil supply/discharge circuit as set forth in claim 1, wherein said valve-opening actuation means (15) is constructed as a fluid pressure actuation type, and a pilot port (F) of the valve-opening actuator means (15) is selectively connectedto a pressurized fluid supply passage (84) and to a pressurized fluid discharge passage (85) through a pressurized fluid supply/dischrge passage (82) and a pressurized fluid supply/dischrge changeover means (83).

3. A presurized oil supply/discharge circuit as set forth in claim 2, wherein said valve-opening actuator means (15) is constructed as a hydraulic actuation type, and said pressurized fluid suppply passage (84) is connected to the oil supply passage (5) and said pressurized fluid discharge passage (85) is connected to the pressurized oil discharge passage (7).

4. A pressurized oil supply/discharge circuit as set forth in claim 1, wherein a flow restrictor means (21) is disposed in said bypass passage (16) of the pressurized oil supply/discharge passage (3) in series with respect to a valve passage **(17*a*) of said bypass opening/closing valve (17)**.

5. A residual pressure holding valve device having a pressure port (P) connected to a working port (A) through a check valve seat (28) and a check valve chamber (29) within a valve casing (27), and a check valve member (30) in the check valve chamber (29) including a valve surface resiliently urged towards a valve closing position against the check valve seat (28) by means of a checking spring (31), said pressure port (P) located to one side of said check valve member (30), said valve device comprising;

a valve-opening actuator means (15) having a valve opening member (35) disposed on the side of said check valve member (30) opposite the side on which the pressure port (P) is located;

a bypass passage (16) extending from said pressure port (P) to said working port (A) in parallel with said check valve seat (28) and said check valve chamber (29); and a bypass opening/closing valve (17) disposed in said bypass passage (16), said bypass opening/closing valve (17) comprising a piston valve member (38) resiliently urged toward a bypass valve seat (40) by means of a residual pressure holding spring (19), said piston valve member (38) being adapted to be separated from the bypass valve seat (40) against the bias of the residual pressure holding spring (19) by means of a pressure within the pressure port (P) under the normal pressure condition wherein the pressure within the pressure port (P) is within a first pressure range ($R_1$) and to be brought into contact with the bypass valve seat (40) for valve closing by means of the residual pressure holding spring (19) under an abnormal pressure condition wherein the pressure within the pressure port (P) has abonormally dropped to a second pressure range ($R_2$).

6. A valve device as set forth in claim 5, wherein at least a prtion of said bypass (16) is disposed within said check valve member (30) and said bypass valve seat (40) is disposed within the check valve member (30).

7. A valve device as set forth in claim 6, wherein said valve-opening actuator means (15) of the check valve (14) includes a fluid pressure piston (33) disposed on the same side of the check valve member (30) as the pressure port (P);

a fluid pressure actuation chamber (34) is formed on one side of said pressure piston (33), the presure port (P) is connected in communication with the other side of the fluid pressure piston (33), and a valve opening member (35) is disposed on said other side of the piston; and within said fluid pressure piston (33) there are disposed said pistion valve member (38) of the bypass opening/closing valve (17) and the residual pressure holding spring (19).

8. A valve device as set forth in claim 6, wherein a valve seat tube (39) is inserted into said check valve member (30) so as to be oil-tightly movable therein, and the bypass valve seat (40) formed in said valve seat tube (39) is resiliently urged toward the valve surface of the piston valve member (38) by means of a return spring (41).

9. A valve device as set forth in claim 8, wherein a throttling valve member (44) is inserted into a tube (**39*a*) of said valve seat tube (39), and said flow restrictor comprises an annular gap formed between said tube port (39*a*) and said throttling valve member (44**).

10. A valve device as set forth in claim 5 wherein a flow restrictor means (21) for restricting flow is arranged in said bypass passage (16) in series with respect to a valve passage (**17*a*) of said bypass opening/closing valve (17**).

11. A valve device as set forth in claim 5, including a hydraulic cylinder body (**1*a*) of a hypdraulic cylinder (1), and wherein the valve casing (27) is fixedly secured to said cylinder body (1*a***).

* * * * *